US005780790A

United States Patent [19]

Benson et al.

[11] Patent Number: 5,780,790

[45] Date of Patent: Jul. 14, 1998

[54] MODULAR ELEVATOR SWITCH CONTROL HOUSING

[75] Inventors: Tom Benson; Marion England, both of Russellville, Ark.

[73] Assignee: Innovation Ind's Inc., Russellville, Ark.

[21] Appl. No.: 792,536

[22] Filed: Jan. 31, 1997

Related U.S. Application Data

[63] Continuation of Ser. No. 415,615, Apr. 3, 1995, abandoned.

[51] Int. Cl.[6] ..... B66B 1/28

[52] U.S. Cl. ..... 187/395; D10/108; 187/414; 187/396; 187/397

[58] Field of Search ..... 187/395, 397, 187/391, 398, 394, 414; 340/332, 286.1, 815.53; D10/108; 116/226

[56] References Cited

U.S. PATENT DOCUMENTS

| | | | |
|---|---|---|---|
| D. 283,685 | 5/1986 | Walser | D10/108 |
| D. 283,687 | 5/1986 | Walser | D10/108 |
| 2,072,439 | 3/1937 | Anderes | 40/130 |
| 5,379,865 | 1/1995 | Berdich et al. | 187/398 |
| 5,460,118 | 10/1995 | Shea et al. | 116/226 |
| 5,490,581 | 2/1996 | Warner et al. | 187/414 |
| 5,507,366 | 4/1996 | Huang | 187/395 |

FOREIGN PATENT DOCUMENTS

| | | | |
|---|---|---|---|
| 0190406 | 8/1986 | European Pat. Off. | B66B 1/46 |
| 0190407 | 8/1986 | European Pat. Off. | H02B 1/10 |
| 9102425 | 6/1991 | Germany | B66B 3/00 |

*Primary Examiner*—Robert Nappi
*Attorney, Agent, or Firm*—Stephen D. Carver

[57] ABSTRACT

A modular elevator control housing with an easily accessibly interior is disclosed. The housing comprises a generally rectangular, elongated casing that is conveniently placed on a wall adjacent to an elevator. The housing protectively encloses elevator operational controls. The housing may replace an existing control housing, mounting over the existing elevator outlet and using existing holes. Alternatively, the housing may be originally installed during building construction. The housing comprises a chassis covered by a display. The chassis comprises a subframe that secures the housing to the wall and a top and bottom cover. The subframe comprises a base bounded by integral, projecting side flanges. Chassis sidewalls are secured to the subframe sides. The inner surfaces of the sidewalls define multiple, parallel channels. Two of the channels seat fasteners to secure the top and bottom covers to the sidewalls. One of the channels captivates fasteners that secure the sidewalls to the subframe. The remaining, sliding channel receives the display components. Interior brackets secured to the subframe cooperate with the sliding channel to support the display in a desired configuration. The display comprises faceplates separated by mating clips. Faceplate numbers may be varied during installation. Mating clips join abutting plates. The interior of the housing may be easily serviced by selectively removing the top or bottom cover and sliding out the faceplates.

25 Claims, 10 Drawing Sheets

MODULAR ELEVATOR SWITCH CONTROL HOUSING

CROSS REFERENCE TO RELATED APPLICATION

This application is a Continuation of prior Ser. No. 08/415,615, Filing Date: Apr. 3,1995, now abandoned, entitled Modular Elevator Switch Control Housing, assigned to Group Art Unit 2111 Examiner R. Nappi.

BACKGROUND OF THE INVENTION

I. Field of the Invention

The present invention relates generally to elevator selection switch housings. More particularly, the present invention is primarily directed to modular elevator control housings that can be either originally or retroactively installed to lower the physical height or position of elevator selection switches. Such devices make the elevator switches more accessible to the handicapped.

II. Description of the Prior Art

Elevators and their associated control housings are well known in the art. Elevator control housings are often conveniently placed upon building walls adjacent elevators doors. The control housings mount the passenger-activated selection switches, and protectively enclose the external switch wiring and circuitry.

Elevator controls typically comprise up and down indicator and selector buttons and "master" or "fireman" key switches. Typically, the housings also display informational material such as warnings, instructions and the like. Displayed information often depends upon local regulations and building requirements.

Conventional existing elevator control housings locate the elevator controls at average waist height or higher. However, with the passage of the Americans with Disabilities Act or ADA, it is now required that elevator controls be located within the immediate reach of those seated in wheelchairs and other handicapped individuals. The ADA regulations specify that elevator controls must be no higher than forty-two inches from the floor. Thus, it is now necessary to remodel or replace existing elevator control units to lower them to the required height.

Some proposed structures have been introduced in response to recent government legislation to lower elevator controls. However, the proposed structures have not solved all of the problems the new legislation has created.

The internal components inside elevator control housings require regular and routine maintenance. Several different components are generally housed inside an elevator control housing. It is often necessary to service only some of the internal components. However, the known prior art fails to anticipate the need for efficient service of these selected portions of the elevator control housings.

Several cities and states have also promulgated regulations dealing with elevators. These local regulations often require certain information to be displayed either on the housing or adjacent to the elevator. The known prior art does not provide a convenient method of manipulating housing covers to accommodate these various display requirements.

Thus, it is desirable to provide an elevator control unit that replaces existing elevator controls without replacing existing control apertures or outlets. It is further desirous to provide a replacement control housing that utilizes existing elevator control apertures while simultaneously lowering the placement of the elevator controls.

Preferably, an improved housing would effectively lower the elevator controls at a minimal installation cost. Such an improved, replacement housing would need to be modular to speed the installation and accommodate various installation parameters.

A modular inner unit that accommodates various external displays while minimizing installation expenses is desirable. A modular elevator control housing would also need to permit selective access to the interior of the housing in an efficient manner.

SUMMARY OF THE INVENTION

My modular elevator control housing comprises an aesthetically pleasing, flat housing that is conveniently mounted on a wall adjacent to an elevator. The housing protectively encloses critical elevator call switches. The new housing may easily be retrofitted in replacement of an existing control housing. It easily mounts over the existing elevator outlet. The housing may also be originally installed during building construction.

The housing comprises an elongated, box-like chassis covered by an indicator display. The chassis comprises a generally rectangular supporting subframe that is flushly secured to the wall. Preferably, the subframe is bounded by integral, upturned flanges protruding from its flat base that provide convenient mounting slots for remaining components.

Separate sidewalls are coupled to the subframe flanges. Top and bottom covers attach to the sidewalls over the ends of the subframe. The inner surfaces of the sidewalls define multiple, parallel grooves. Smaller grooves seat appropriate fasteners (i.e., self tapping sheet metal screws) to secure the top and bottom covers to the sidewalls. One of the grooves secures the sidewalls to the subframe flanges. The remaining, sliding groove receives the display. Interior brackets secured to the subframe flanges cooperate with the sliding groove to support the display in a desired configuration.

The display comprises a selected number of faceplates separated by mating clips. In a preferred embodiment, three faceplates comprise the display. An alternative embodiment employs two abutting faceplates of different lengths. In another embodiment the display comprises a single, integral faceplate constrained as before within the sliding grooves.

The faceplates may contain graphic or textual information. The faceplates may support elevator operational controls. The configuration of the faceplates may be selectively arranged during housing installation. The faceplates may be removed or rearranged as desired.

Desired faceplates are quickly and easily installed. They slide between the grooves in the sidewalls of the housing. Mating clips supported by the interior brackets separate abutting faceplates. The mating clips include channels that seat the display faceplates. A faceplate may be removed or replaced by temporarily removing the top or bottom cover and sliding the desired faceplate and any necessary mating clip out of the chassis. The removed faceplate may be altered or replaced as desired. The interior of the housing is easily serviced by temporarily removing selected faceplates.

Thus, a primary object of the present invention is to provide a modular elevator control housing.

A basic object is to lower elevator call switches.

Another primary object is to simplify the removal and replacement of elevator control housing display faceplates.

An additional object is to simplify maintenance chores by facilitating service access to the interior of the housing.

Yet another fundamental object is to make it easier for elevator service personnel, suppliers and operators to comply with the Americans with Disabilities Act.

Still another object of the present invention is to provide an elevator control housing that easily retrofits over preexisting elevator controls without substantial modification.

A related object is to provide a replacement control housing that utilizes existing elevator control apertures while simultaneously lowering the placement of the elevator switches.

Another basic object is to provide an improved housing that effectively lowers the elevator controls at a minimal cost.

A related object is to provide a modular housing of the character described that provides an easily customized display.

Another basic object is to provide a chassis for the housing described that accommodates various external displays while minimizing installation expenses.

Yet another basic object of the invention is to provide a modular housing that permits selective access to portions of the interior of the housing in an efficient manner.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

Detailed Description

Figure 1:
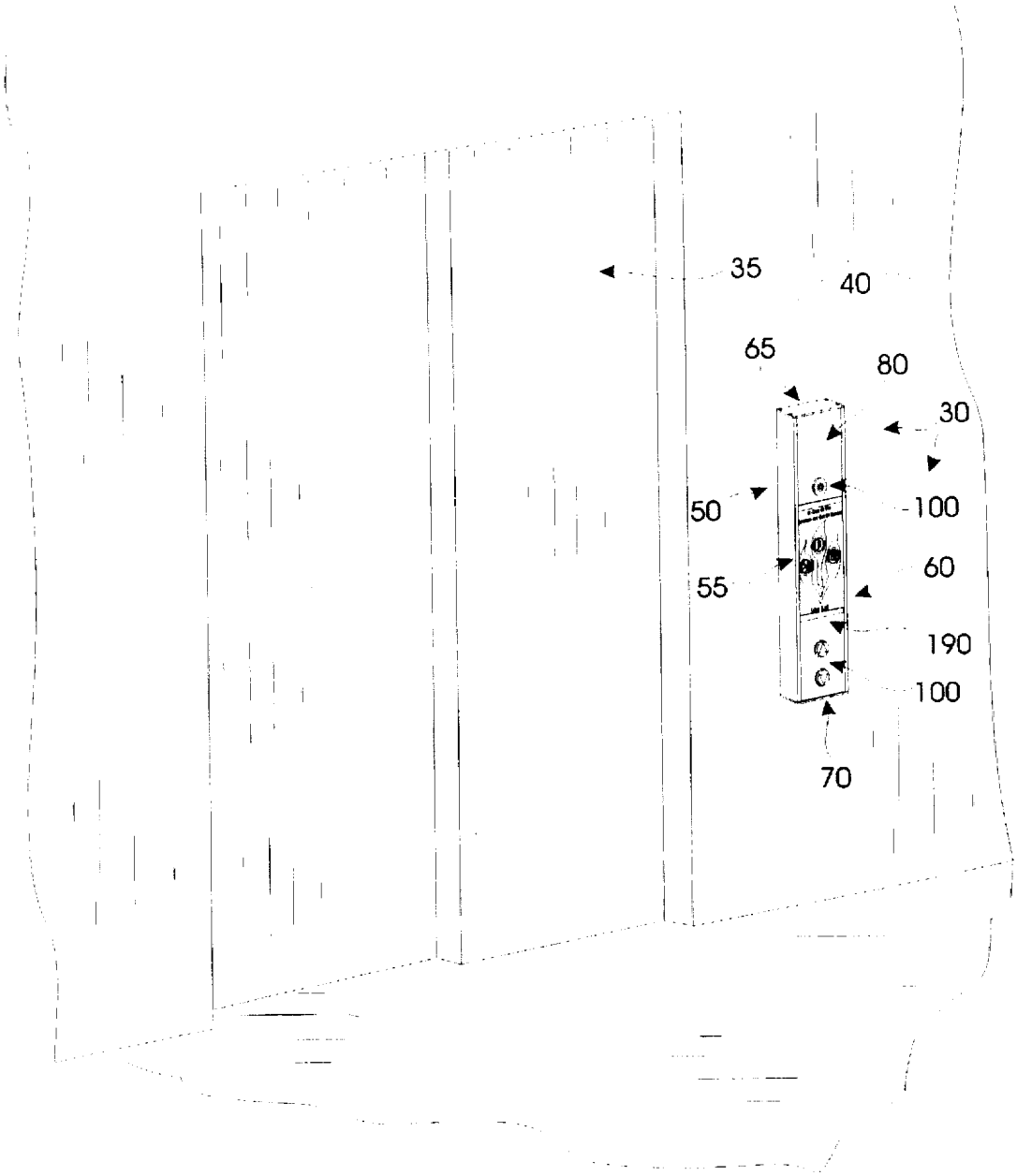
FIG. 1 is a fragmentary environmental view of a preferred embodiment of the Modular Elevator Switch Control Housing, showing it installed upon a wall adjacent the elevator doors.

With attention directed now to the accompanying drawings, the modular elevator switch control housing is broadly designated by the reference numeral 30 (FIGS. 1–8). Housing 30 readily retrofits to existing elevator installations to replace obsolete elevator control panels. Housing 30 permits the elevator controls to be lowered or altered without relocating original elevator control outlets. Alternatively, it may be readily installed as original equipment.

Figure 2:
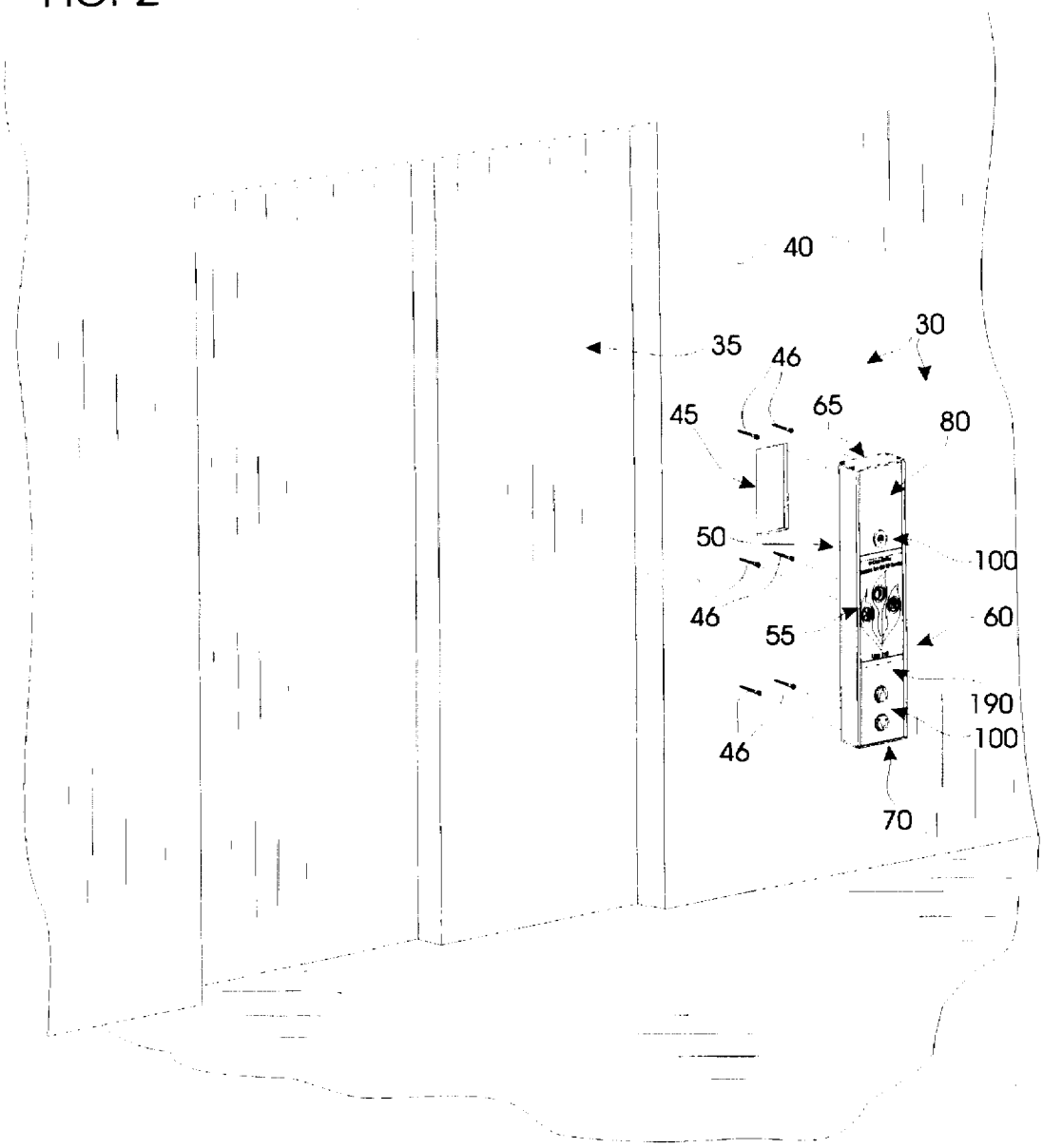
FIG. 2 is a partially exploded, fragmentary environmental view similar to FIG. 1, showing the elevator control outlet and the attachment of the housing to the wall.

Generally, the control housing 30 is placed adjacent conventional elevator doors 35 (FIGS. 1–2). The housing 30 is installed on a wall 40 to protectively cover an elevator control outlet 45. Several self-tapping screws 46 selectively secure the housing 30 to the wall 40. During construction, the fasteners 46 may be directly screwed within appropriate wall anchors by first drilling new mounting holes 48.

Figure 3:
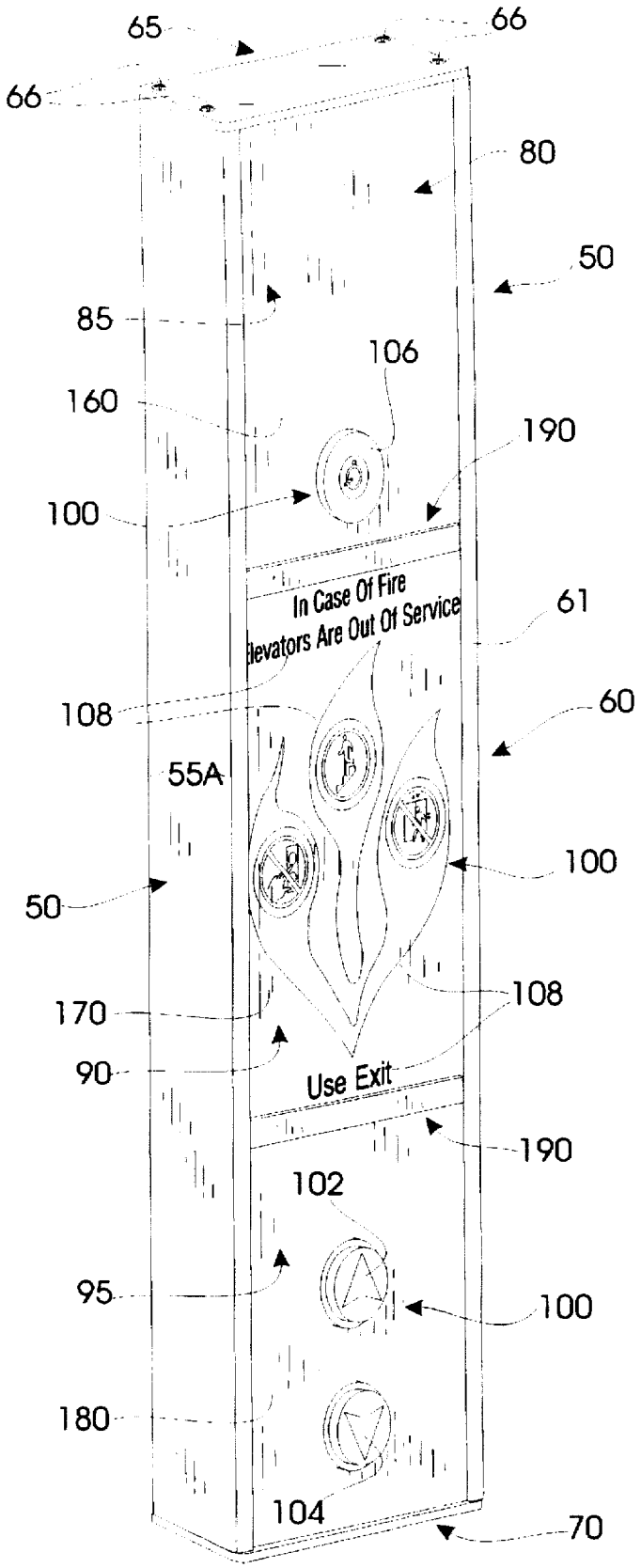
FIG. 3 is an enlarged, front isometric view of a preferred control housing with three display faceplates.
Figure 4:
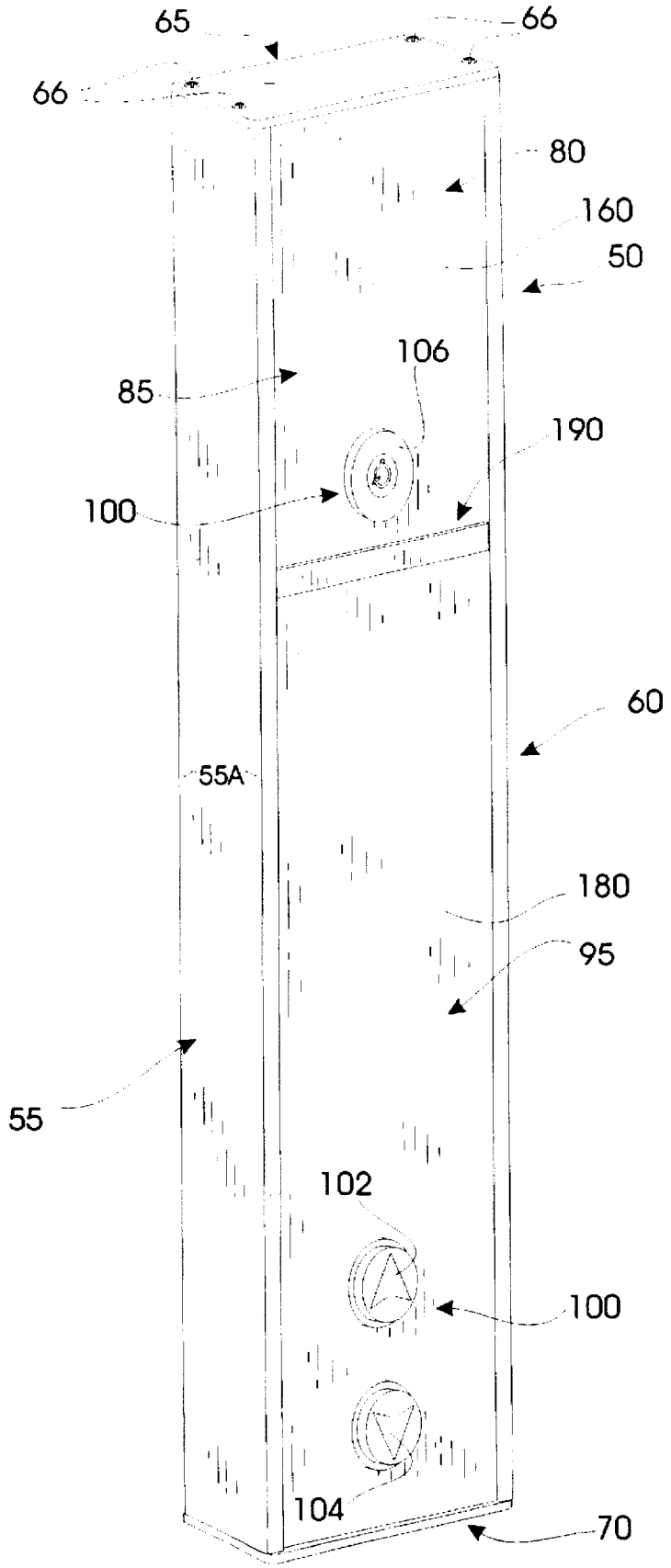
FIG. 4 is an enlarged, front isometric view similar to FIG. 3, showing an alternative embodiment with two display faceplates.
Figure 5:
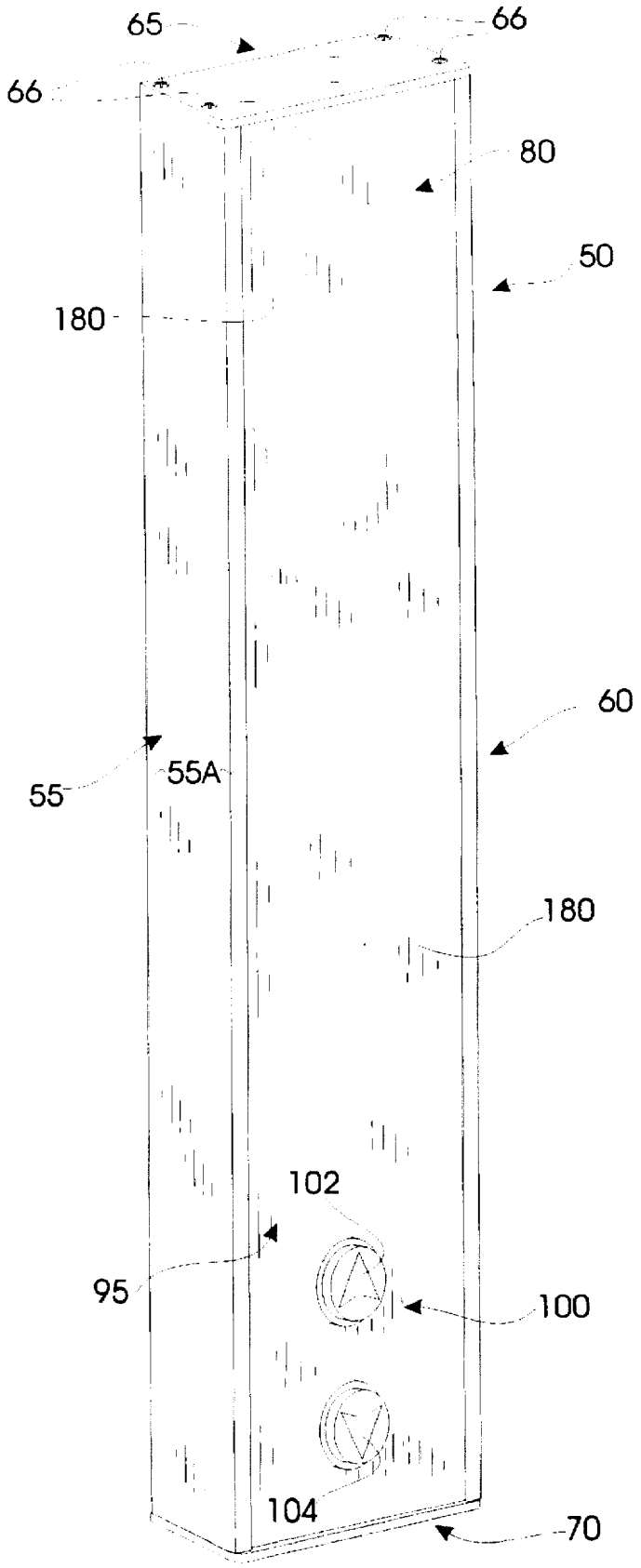
FIG. 5 is an enlarged, front isometric view similar to FIGS. 3 and 4, showing another alternative embodiment with a single display faceplate.

Housing 30 comprises several modular components that are easily assembled at the site. Control housing 30 comprises a generally rectangular, parallelepiped chassis 50 (FIGS. 3–5). Chassis 50 defines an interior 52 as described hereinafter. The exterior of the chassis has a pair of spaced apart, vertically oriented, sidewalls 55, 60 bounded by a spaced apart, horizontally disposed, top cover 65 and bottom cover 70. The interior of the chassis 50 is covered by a display 80.

Chassis 50 comprises a subframe 110 (FIGS. 6, 7) bounded by the sidewalls 55, 60 and the top and bottom covers 65, 70. The subframe 110 secures the housing 30 to the wall 40. Preferably subframe 110 comprises an elongated, generally rectangular base 112 that has a pair of integral, upturned longitudinal flanges 114 forming opposed sides. The flat subframe base 112 is secured to the wall 40 over outlet 45 (FIG. 6) with fasteners 46. A series of screw holes 113 penetrate the base 112 at regular, spaced apart intervals to facilitate installation. Both sides 114 comprise several regularly spaced apart ellipsoidal mounting slots 115.

A primary wiring orifice 118 penetrates the subframe base 112. The previous wiring used for the older elevator control housing or the new wiring may be routed through orifice 118. On some models a larger orifice 116 penetrates the subframe 110 below orifice 118. Orifice 116 will allow a firemans switch to mount through 110 and into the existing electrical box. The mounting slots 115 facilitate attachment of the modular sidewalls 55, 60 as well as the support brackets 130. Slots 115 are penetrated by a bolt 120 which is secured by a nut 122. The bolt 120 and nut 122 combination secures the brackets 130 and the display 80.

The brackets 130 support and secure the display 80 to the subframe 110. Each bracket 130 comprises a flat plate 132 with an integral flange 134 projecting inwardly from each end. A bidirectional slot 136 is defined in each flange 134. Bolts 120 captivate a selected portion of slot 136 to secure the bracket 130 to the subframe 110. The bidirectional outline of slot 136 permits vertical and horizontal adjustments to the position of the bracket relative to the subframe 110. When the bracket 130 is installed, its upper lip 138 extends between sidewalls 55, 60.

Sidewalls 55 and 60 are identical and attach to the subframe flanges 114 similarly. Sidewalls 55, 60 comprise a generally flat, elongated rectangular plate 56,61. The exterior surfaces (i.e., surface 55A in FIGS. 4, 5) of the sidewalls 55, 60 are polished and smooth. Several parallel Grooves are defined in each interior wall surface 140 and extend along the entire length of the sidewall 55.

An attachment groove 142 captivates the fastener heads 124 that secure the sidewalls to the subframe side flanges.

The attachment groove 142 is internally T-shaped. The groove throat 142A admits fastener heads. Two ledges 142B, 142C jut partially into the groove throat 142A. The ledges 142B, 142C tighten against the inner surface 125 of the bolt head 124. Thus, the bolt is securely entrained inside groove 142.

Two smaller grooves 144, 146 border groove 142 on each side, grooves 144, 146 seat the self tapping sheet metal screws 66 for the top cover 65 and screws 71 for the bottom cover 70. Screws 66 and 71 are inserted through holes 67 and 72 defined in the top and bottom covers 65, 70 respectively.

A sliding groove 150 extends along the forward edge of sidewalls 55, 60. The sliding groove 150 receives the longitudinal edges of the faceplates 85, 90 and 95. Preferably, groove throat has a rectangular cross-section. The groove 150 cooperatively secures the faceplates between the top and bottom covers 65, 70. The groove 150 extends along the entire length of the sidewalls 55, 60. The cross-section of groove 150 is rectangular. The groove 150 horizontally retains the components of the elongated, covering display 80.

Figure 6:
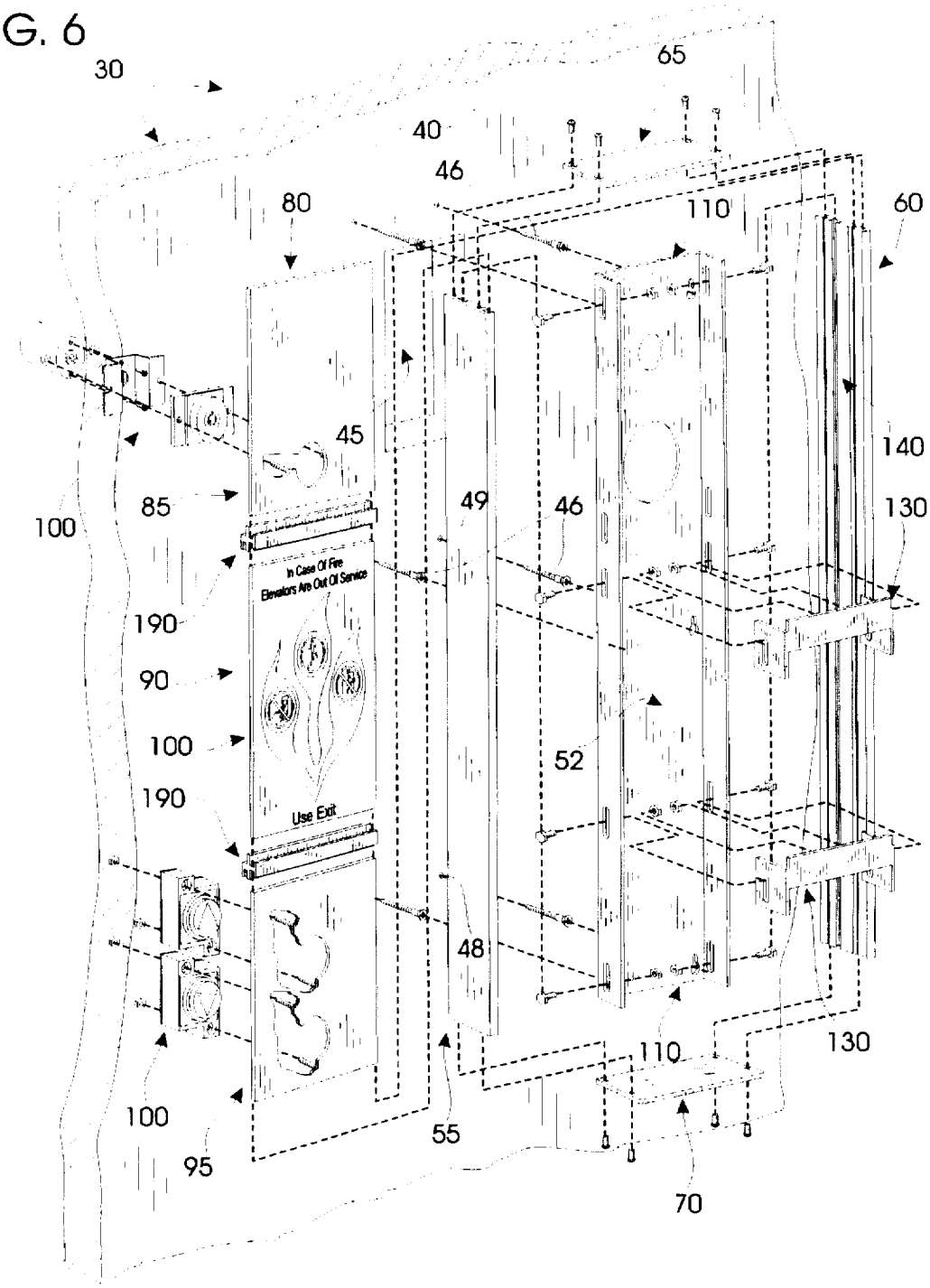
FIG. 6 is an exploded, fragmentary front isometric view of the housing of FIG. 3.
Figure 7:
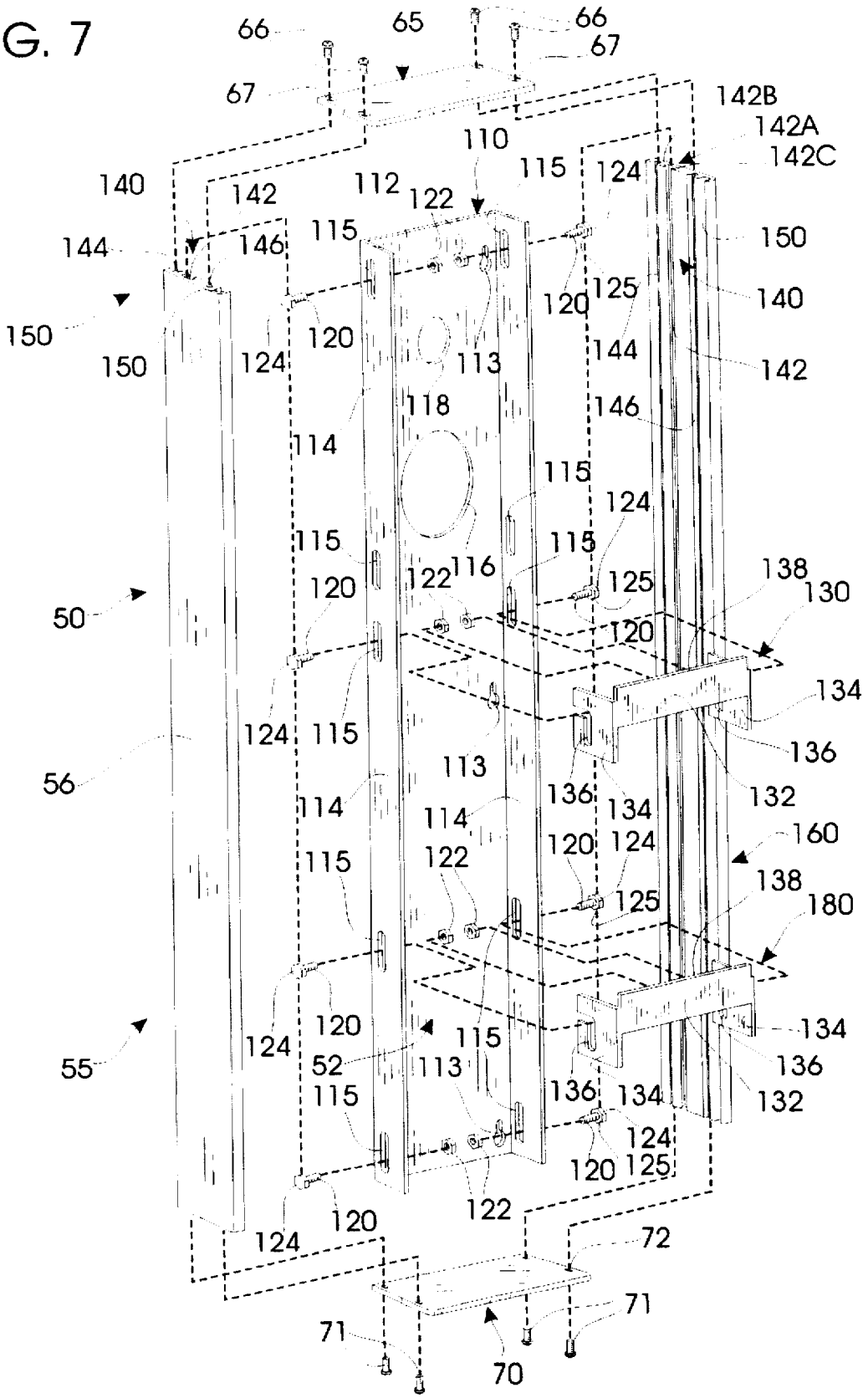
FIG. 7 is an enlarged, exploded, front isometric view of the preferred chassis.
Figure 8:
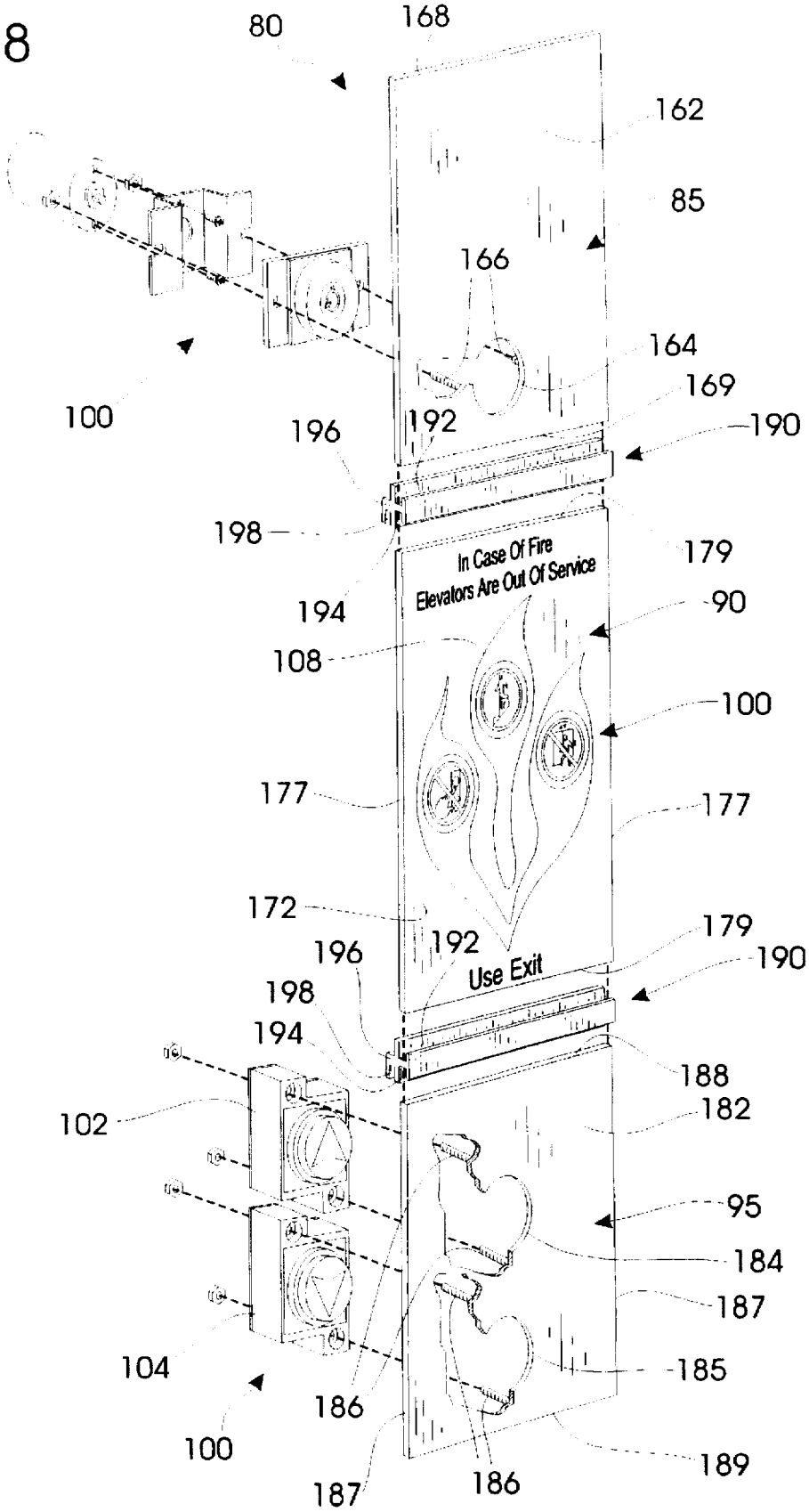
FIG. 8 is an enlarged, exploded, front isometric view of the three faceplate display, with portions thereof broken away for clarity.
Figure 9:
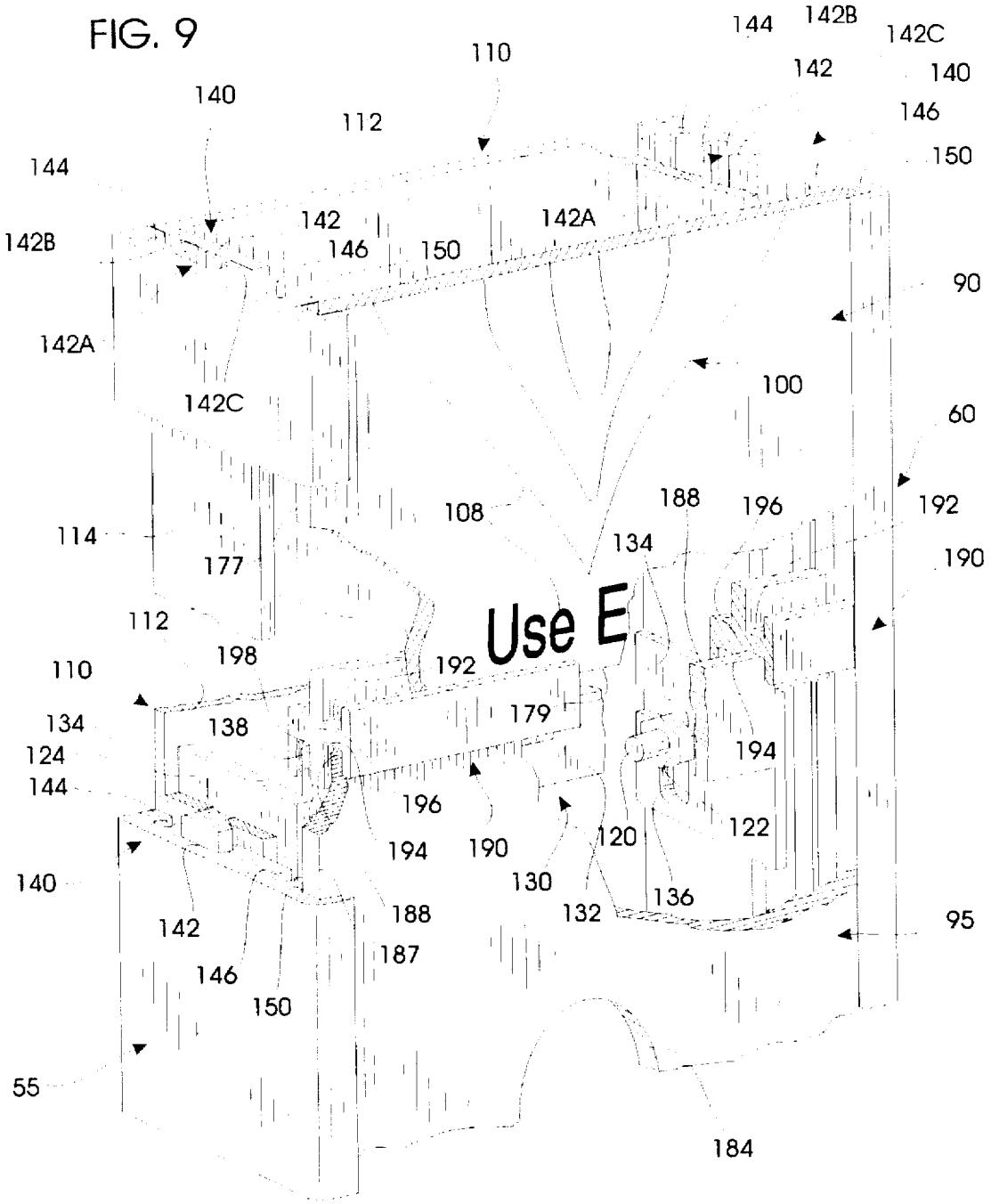
FIG. 9 is a greatly enlarged, fragmentary, front isometric view of the preferred housing, with portions omitted and broken away for clarity; and, FIG. 10 is a greatly enlarged, fragmentary, front isometric view of the preferred housing with the arrows showing directions of movement, and with portions thereof omitted or broken away for clarity.
Figure 10:
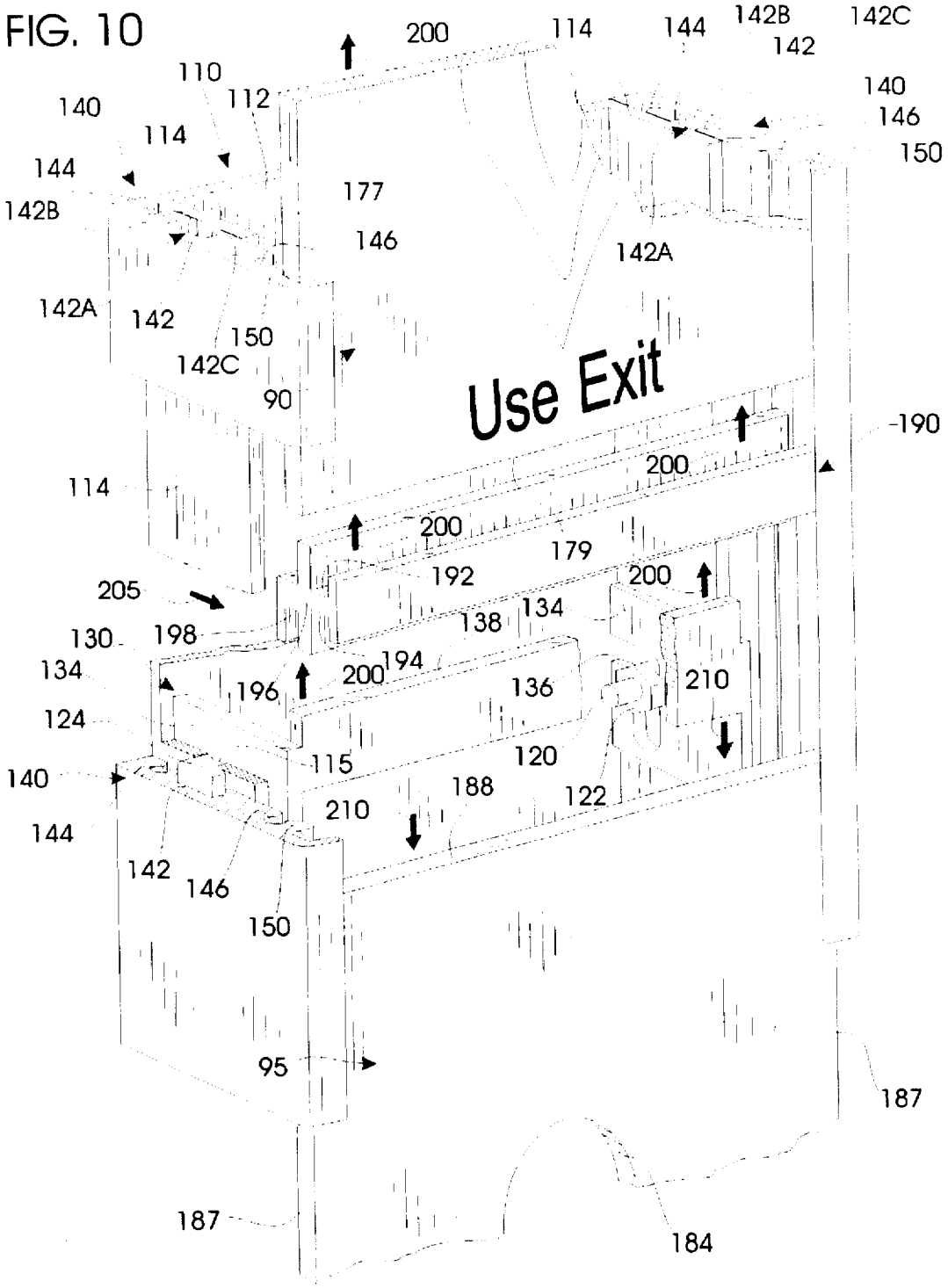

Display 80 readily couples to the chassis 50. The display comprises a selection of faceplates joined by mating clips. In one preferred embodiment, the display comprises faceplates 85, 90 and 95 (FIGS. 3, 6 and 7). In one alternative embodiment, the display comprises only two faceplates 85 and 95 (FIG. 4). In another alternative embodiment, the display comprises a single rectangular faceplate 95 (FIG. 5). In all of the embodiments, the chassis 50 remains substantially the same. The display 80 may be altered without disturbing the interior of the housing 30.

In the preferred and alternative embodiments, the faceplates are arranged and configured at the factory. The number of faceplates used in a particular installation depends upon the desired length and configuration of the housing 30. The plates typically support elevator operational controls 100. Typical elevator controls include up and down selectors 102, 104, key 106 and informational material 108. However, the invention is not intended to be limited to a particular faceplate configuration or operational controls since the faceplates may be easily changed to support countless variations.

In the preferred embodiment and alternative embodiments, the rigid, elongated faceplates are similar to one another in general outline and horizontal width. The faceplates are generally parallelepiped, 11GA stainless steel, brass or muntz plates. However, as seen in FIG. 4, the faceplates may be of different lengths to accommodate various installation parameters. And, as seen in FIG. 5, any number of faceplates may be utilized for the display.

In the preferred embodiment, plates 85, 90 and 95 compromise rigid, flat, finished front surfaces 160, 170, 180 that each have a rectangular periphery. Surface 160 is penetrated by a circular orifice 164 that permits the installation of a key control 106. Mounting bolts 166 project from the rear surface of plate 85. The longitudinal plate edges 167 are captivated by groove 150 when the faceplate 85 is installed.

Surface 170 contains written information or other designs on its surface. Of course, surface 170 could be selectively configured to support elevator operational controls as desired. The longitudinal plate edges 177 are captivated by groove 150 when the faceplate 90 is installed.

Surface 180 is penetrated by circular orifices 182 and 183. Orifices 182 and 183 permit control selectors 102 and 104 to protrude through housing 30. Several mounting bolts 186 protrude from the rear surface of plate 95. The longitudinal plate edges 187 are captivated by groove 150 when the faceplate 95 is installed. Of course, the surfaces of each plate could be penetrated by additional orifices if desired.

When the plates are installed, each plate's horizontal edges 168, 169, 178, 179, 188 and 189 extend between the sidewalls 55, 60. The horizontal edges mate with clips or the top or bottom covers to seal the internal casing 52.

Preferably, a special multi-channeled clip 190 is used to connect each pair of abutting plates. Clip 190 comprises an upper and lower forward channel 192, 194 that project forwardly from the clip body 196. A spaced apart rear channel 198 projects rearwardly from the clip body. The rear channel 198 runs parallel to the front channels 192, 194.

The rear support channel 198 secures the clip to upper bracket lip 138. The upper and lower channels 192, 194 secure the horizontal edges of two abutting plates (i.e., 169 to 178 and 179 to 188) therein. Thus, when the housing is assembled, the clips cooperate with the sliding groove and the top and bottom covers to secure the faceplates of the display to the chassis.

In the alternative embodiments, the plates are similar and the same reference numerals have been used to show the same components. The installation and service of the preferred and alternative embodiments are the same. Thus, only the preferred embodiment will be discussed.

Installation and Interior Access

The housing 30 installs adjacent to an elevator to mount operational controls and information. During replacement installations, an installer removes the old, pre-existing elevator control housing to expose the wiring outlet 45. During an initial installations, the wiring outlet 45 is left open during construction.

The installer attaches the chassis 50 to the wall 40. Fasteners 46 screw into new holes 48 that are drilled as required. Fasteners 46 are inserted into the subframe base orifices 113 to firmly secure the subframe 110 to the wall 40.

When subframe 110 is in place, it substantially covers outlet 45. The outlet wiring is routed through orifices 116, 118 so that new elevator controls may be wired. Once the elevator controls have been wired, the rest of the chassis 50 is attached to the subframe 50.

Bolts 120 are inserted in slots 115 and nuts 122 are attached thereto. Brackets 130 are then attached by sliding slot 136 over the bolt shaft and hand tightening the nuts 122 when the bracket is properly positioned. The sidewalls 55, 60 are installed by positioning bolt heads 125 in each groove 150, sidewalls 55 and 60 then slide down the bolts. When the sidewalls 55, 60 are properly positioned, nuts 124 are firmly tightened down to secure the sidewalls and the brackets. Preferably, the bottom cover 70 is attached to the sidewalls 55, 60. Self tapping screws 71 penetrate orifices 72 and are secured by grooves 144, 146 on each sidewall.

The display 80 is installed to cover the internal casing 52, subframe 110 and the elevator wiring. The faceplates 85, 90 and 95 are simultaneously inserted into the interior grooves 150 on the sidewalls. The grooves 150 slidably captivate the longitudinal edges 167, 177, 187 of the faceplates. The clips 190 secure the intermediate sections of the plates to the bracket 130. The top and bottom covers cooperate with the interior grooves to secure the display therebetween.

Faceplate 95 is inserted between sidewalls 55, 60 in the interior grooves 150. Plate 95 slides down grooves 150 until contacting the bottom cover 70.

Edge 189 rests upon the interior surface of bottom cover 70.

A clip 190 installs on top of faceplate 95. The rear channel 196 of each clip mounts the upper bracket lip 138 to secure the clip thereto. The lower front channel 194 mounts upper plate edge 188.

Faceplate 90 is inserted into grooves 150 like plate 95. Plate 90 slides down grooves 150 until contacting the clip 190. Edge 179 inserts into upper front channel 192 and rests therein.

A second clip 190 installs on top of faceplate 90. The rear channel 196 mounts the upper bracket lip 138 of a second bracket 130 to secure the clip thereto. The lower front channel 194 mounts upper plate edge 178.

Faceplate 85 is inserted into grooves 150 like plates 90 and 95. Plate 85 slides down grooves 150 until contacting the second clip 190. Edge 169 inserts into upper front channel 192 and rests therein.

The top cover 65 is attached to the sidewalls 55, 60. Self tapping screws 66 penetrate orifices 67 and are secured by grooves 144, 146 on each sidewall. Edge 168 supports the interior surface of the top cover 65.

The display 80 may be altered without disturbing the chassis 50. The top cover 65 or bottom cover 70 may be selectively, temporarily removed to replace or remove a chosen faceplate. It may be desirable to change or replace faceplates to accommodate changing regulations or building remodeling. It may also be desirable to access the housing interior.

The faceplates may be removed to service the interior of the housing 30. In the preferred embodiment, the top or bottom cover is selectively removed to displace faceplates 85 or 95. Clips 190 retain the remaining faceplates. One of the clips 190 must be removed to displace faceplate 90. In the alternative embodiments, the selected faceplate may be removed by simply removing the necessary top or bottom cover.

The faceplates may be displaced upwardly in the direction of arrow 200 if the top cover 65 is removed. The faceplates may be displaced downwardly in the direction of arrow 210 if the bottom cover 70 is removed. Clip 190 may only be removed if the top cover 65 is removed. Clip 190 is removed by lifting it upwardly and then outwardly in the direction of arrow 205. Thus, the internal casing 52 may be easily accessed by temporarily removing selected faceplates.

Additionally, the display 80 may be selectively altered without altering the chassis 50. The faceplates may be replaced as desired to impart a different "look" to the housing.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A modular control housing adapted to be mounted adjacent an elevator, said housing comprising:

a generally rectangular subframe adapted to be mounted upon a supporting surface, said subframe having opposed sides;

a pair of generally rectangular spaced apart, modular sidewalls adapted to be secured to said subframe sides, each sidewall having a top and a bottom;

first and second elongated, parallel interior grooves defined in each sidewall;

fastener means captivated within said first grooves for engaging said subframe sides to secure said sidewalls;

top and bottom covers extending between said sidewalls at their tops and bottoms;

at least one generally planar faceplate captivated between said sidewall second interior grooves;

at least one clip extending generally between said sidewalls a front channel defined in each at least one clip for captivating at least a portion of a faceplate, said clip comprising an elongated rear channel parallel with and spaced apart from said front channel;

a bracket extending between said sidewalls for securing said at least one clip said bracket comprising a lip for engaging said clip rear channel; and at least one elevator control comprising a switch, display indicator or the like accessible through or disposed upon said faceplate.

2. The housing as defined in claim 1 wherein said housing comprises at least a pair of abutting faceplates, and said at least one clip comprises separate upper and lower front channels for captivating adjoining edges of said abutting faceplates.

3. A control housing adapted to be mounted adjacent to an elevator, said housing comprising:

a chassis adapted to be secured to a planar support adjacent said elevator, said chassis comprising:

a pair of spaced apart sides comprising a top, a bottom, and at least one elongated, interior groove;

top and bottom covers extending between said sides;

a display disposed upon said chassis, said display comprising:

at least one flanged bracket extending between said One sides, at least one clip horizontally spanning said chassis, said clip comprising at least one front channel and an elongated rear channel parallel with and spaced apart from said front channel for engaging said bracket;

at least one generally planar faceplate covering said chassis and comprising longitudinal edges, the longitudinal edges of each faceplate slidably captivated within said interior grooves and said at least one front channel.

4. The housing as defined in claim 3 wherein said flanged bracket further comprises slot means for securing said bracket to each of said subframe sides.

5. The housing as defined in claim 4 wherein said display comprises at least a pair of abutting faceplates, and said at least one clip comprises separate upper and lower front channels for captivating adjoining faces of said abutting faceplates.

6. The housing as defined in claim 3 wherein each of said sides interiorly defines a pair of smaller grooves parallel to said interior grooves, said smaller grooves adapted to seat fasteners to secure said top and bottom covers.

7. A control housing with an exteriorly accessible interior adapted to be mounted adjacent to an elevator, said housing comprising:

a rigid chassis adapted to be secured to a supporting surface adjacent the elevator, said chassis comprising:

a subframe attached to said surface, said subframe comprising a generally planar base and a pair of spaced apart sides;

a spaced apart, elongated sidewall secured to each of said subframe sides, each of said sidewall comprising a top, a bottom, and first and second parallel, interior grooves facing said subframe;

fastener means at least partially captivated within said first grooves of said sidewalls for mounting said sidewalls to said subframe sides; and, top and bottom covers extending between said sidewall tops and said sidewall bottoms; and a display mounted upon said chassis, said display comprising:

at least one clip horizontally spanning said chassis, said clip comprising at least one front channel [; and,] and an elongated rear channel parallel with and spaced apart from said front channel;

at least one flanged bracket extending between said sides, said bracket engaging said rear channel to secure said clip, and, at least one generally planar faceplate at least partially covering said chassis, said at least one faceplate comprising edges slidably captivated within said second grooves of said sidewalls and said at least one front channel in said clip.

8. The housing as defined in claim 7 wherein said flanged bracket further comprises slot means for adjustably securing said bracket to each of said sides.

9. The housing as defined in claim 8 wherein said display comprises at least a pair of abutting faceplates, and said at least one clip comprises separate upper and lower front channels for captivating adjoining faces of said abutting faceplates.

10. The housing as defined in claim 9 wherein each of said sidewalls further comprises third and fourth interiorly defined grooves parallel to said first and second grooves, said third and fourth grooves adapted to seat fasteners to secure said top and bottom covers.

11. An elevator control housing adapted to be mounted adjacent to an elevator, said housing comprising: a chassis adapted to be secured to a planar support adjacent the elevator, said chassis comprising:

a subframe attached to said planar support, said subframe comprising a planar base and a pair of spaced apart sides;

a spaced apart, elongated sidewall secured to each of said subframe sides, each of said walls comprising a top, a bottom, and at least one elongated, interior groove facing said subframe;

top and a bottom covers extending between said sidewall tops and sidewall bottoms;

a display adapted to be disposed upon said chassis, said display comprising:

at least one flanged bracket extending between said sidewalls:

at least one clip horizontally spanning said chassis, said clip comprising separate upper and lower front channels and an elongated rear channel parallel with and spaced apart from said front channels adapted to engage said flanged bracket, at least two abutting, generally planar faceplates covering said subframe, the longitudinal edges of each faceplate slidably captivated within said interior grooves and the abutting edges of said faceplates [are] being captivated within said channels; and, wherein at least one of said faceplates comprises means for mounting an elevator control switch.

12. The housing as defined in claim 11 wherein said flanged bracket further comprises slot means for securing said bracket to each of said sides.

13. The housing as defined in claim 12 wherein each of said sides further interiorly defines a pair of smaller grooves parallel to said interior grooves, said smaller grooves adapted to seat fasteners to secure said top and bottom covers.

14. An elevator housing adapted to be mounted adjacent to an elevator, said housing comprising:

a chassis adapted to be secured to a planar support adjacent said elevator, said chassis comprising:

pair of spaced apart, grooved sides; top and a bottom covers extending between said sides;

a faceplate assembly adapted to be disposed upon said chassis, said faceplate assembly comprising:

at least one flanged bracket horizontally spanning said chassis;

at least one clip comprising a rear mounting channel engaged by said bracket and at least one front channel;

at least one generally planar faceplate, the longitudinal edges of each faceplate slidably captivated in said interior grooves; and, wherein at least one of said faceplates is penetrated by an elevator control associated with said elevator.

15. The housing as defined in claim 14 wherein said flanged bracket further comprises slot means for securing said bracket to each of said sides.

16. The housing as defined in claim 15 wherein said display comprises at least a pair of abutting faceplates, and said at least one clip comprises separate a 14 upper and lower front channels for captivating adjoining faces of said abutting faceplates.

17. The housing as defined in claim 16 wherein each of said sides further comprises a pair of smaller grooves parallel to each of said side grooves, said smaller grooves adapted to seat fasteners to secure said top and bottom covers.

18. An elevator housing for retrofitting to existing elevator installations, said housing comprising:

a subframe comprising a planar base and a pair of spaced apart sides;

a spaced apart, elongated sidewall secured to each of said subframe sides, each of said sidewalls comprising a top, a bottom, and at least one elongated, interior groove facing said subframe;

top and bottom covers extending between said sidewall tops and sidewall bottoms;

a display adapted to be disposed upon said chassis, said display comprising:

at least one bracket extending between said sidewalls;

at least one clip horizontally spanning said chassis, said clip comprising separate upper and lower front channels and an elongated rear channel parallel with and spaced apart from said front channels that engages said bracket;

at least two abutting, generally planar faceplates covering said subframe and comprising longitudinal edges, the longitudinal edges of each faceplate slidably captivated within said interior grooves and the abutting edges of said faceplates being captivated by said channels; and, wherein at least one of said faceplates is penetrated by a switch associated with said elevator.

19. The housing as defined in claim 18 wherein said flanged bracket further comprises slot means for securing said bracket to each of said sides.

20. The housing as defined in claim 19 wherein each of said sides further said smaller grooves adapted to seat fasteners to secure said top and bottom covers.

21. A modular, surface-mounted control housing for elevators, said housing comprising: a subframe adapted to be mounted to a wall or the like adjacent an elevator, said subframe comprising a base plate adapted to contact said wall or the like and a pair of spaced apart, generally parallel sides projecting substantially perpendicularly outwardly from said base plate away from said wall; a pair of extruded sidewalls adapted to be secured to said base plate sides in parallel, spaced-apart relation, each sidewall comprising first and second elongated, parallel interior grooves facing said subframe; fastener means for engaging said subframe sides to secure said sidewalls thereto, said fastener means slidably captivated within said first grooves for permitting the sidewalls to be vertically, slidably adjusted with respect to said subframe;

at least one generally planar faceplate forming a front of said housing and adapted to mount or display an elevator control, a switch, an indicator or the like, said at least one faceplate extending generally between said extruded sidewalls and slidably captivated between said second interior grooves in spaced, generally parallel relation to said base plate, whereby the faceplate may be removed or installed by sliding it vertically with respect to said housing within said second interior grooves;

a top cover extending between said sidewalls and forming a removable housing top; and, a spaced apart bottom cover extending between said sidewalls and forming a removable housing bottom.

22. A modular, surface-mounted control housing for elevators, said housing comprising:

a subframe adapted to be mounted to a wall or the like adjacent an elevator, said subframe comprising a base plate adapted to contact said wall or the like and a pair of spaced apart, generally parallel sides projecting substantially perpendicularly outwardly from said base plate away from said wall;

a pair of extruded sidewalls adapted to be secured to said base plate sides in parallel, spaced-apart relation, each sidewall comprising first and second elongated, parallel interior grooves facing said subframe;

fastener means for engaging said subframe sides to secure said sidewalls thereto, said fastener means slidably captivated within said first grooves of said sidewalls for permitting the sidewalls to be vertically adjusted with respect to said subframe;

a plurality of generally planar faceplates forming a front of said housing and adapted to mount or display at least one elevator control, switch, indicator or the like, said faceplates extending generally between said extruded sidewalls and slidably captivated between said second interior grooves in spaced, generally parallel relation to said base plate, whereby the faceplates may be removed or installed by sliding them vertically with respect to said housing within said second interior grooves;

a top cover extending between said sidewalls and forming a removable housing top;

a spaced apart bottom cover extending between said sidewalls and forming a removable housing bottom; and, wherein said elevator control, switch, indicator or the like is accessible exteriorly of said housing for user access or viewing.

23. A modular, surface-mounted control housing for elevators, said housing comprising:

a subframe adapted to be mounted to a wall or the like adjacent an elevator, said subframe comprising a base plate adapted to contact said wall or the like and a pair of spaced apart, generally parallel sides projecting outwardly from said base plate away from said wall;

a pair of spaced apart sidewalls, each sidewall comprising first and second elongated, parallel interior grooves facing said subframe;

fastener means for engaging said subframe sides to secure said sidewalls thereto, said fastener means slidably captivated within said first grooves for permitting the sidewalls to be vertically adjusted with respect to said subframe;

removable faceplate means for forming a front of said housing and mounting or displaying an elevator control, a switch, an indicator or the like, said faceplate means extending generally between said extruded sidewalls and slidably captivated between said second interior grooves in spaced, generally parallel relation to said base plate, whereby said faceplate means may slide vertically with respect to said housing;

clip means extending generally between said sidewalls for captivating at least a portion of said faceplate means, said clip means comprising a rear channel;

a bracket extending between said sidewalls for securing said clip means, said bracket comprising a lip for engaging said rear channel;

a top cover extending between said sidewalls and forming a removable housing top; and, a spaced apart bottom cover extending between said sidewalls and forming a removable housing bottom.

24. A modular, surface-mounted control housing for elevators, said housing comprising:

a subframe adapted to be mounted to a wall or the like adjacent an elevator, said subframe comprising a base plate adapted to contact said wall or the like and a pair of spaced apart, generally parallel sides projecting outwardly from said base plate away from said wall;

a pair of spaced apart sidewalls, each sidewall comprising first and second elongated, parallel interior grooves facing said subframe;

fastener means for engaging said subframe sides to secure said sidewalls thereto, said fastener means slidably captivated within said first grooves for permitting the sidewalls to be vertically adjusted with respect to said subframe;

a plurality of generally planar faceplates forming a front of said housing and adapted to mount or display at least one elevator control, switch, indicator or the like, said faceplates extending generally between said extruded sidewalls and slidably captivated between said second interior grooves in spaced, generally parallel relation to said base plate, whereby the faceplates may be removed or installed by sliding them vertically with respect to said housing within said second interior grooves;

clip means extending generally between said sidewalls for captivating at least a portion of abutting faceplates, said clip means comprising a rear channel;

a bracket extending between said sidewalls for securing said clip means, said bracket comprising a lip for engaging said rear channel;

a top cover extending between said sidewalls and forming a removable housing top; and, a spaced apart bottom cover extending between said sidewalls and forming a removable housing bottom.

25. A modular, surface-mounted control housing for elevators, said housing comprising:

a subframe adapted to be surface mounted to a wall or the like adjacent an elevator, said subframe comprising a base plate adapted to contact said wall or the like and a pair of spaced apart, generally parallel sides projecting outwardly from said base plate away from said wall;

a pair of spaced apart sidewalls, each sidewall comprising first and second elongated, parallel interior grooves facing said subframe;

fastener means for engaging said subframe sides to secure said sidewalks thereto, said fastener means slidably captivated within said first grooves for permitting the sidewalls to be vertically, slidably adjusted with respect to said subframe;

a plurality of generally planar faceplates forming a front of said housing and adapted to mount or display an elevator control, a switch, an indicator or the like, each faceplate extending generally between said extruded sidewalls and slidably captivated between said second interior grooves in spaced, generally parallel relation to said base plate, whereby the faceplates may be removed or installed by sliding them vertically with respect to said housing;

clip means extending generally between said sidewalls and disposed between abutting faceplates for captivating at least a portion of each abutting faceplate, said clip means comprising a rear channel;

internal bracket means engaging said rear channel for securing said clip means, said clip means extending generally between said sidewalls;

a top cover extending between said sidewalls and forming a removable housing top; and, a spaced apart bottom cover extending between said sidewalls and forming a removable housing bottom.

* * * * *